US010034095B2

(12) United States Patent
Mao

(10) Patent No.: US 10,034,095 B2
(45) **Date of Patent: *Jul. 24, 2018**

(54) MINIATURE SPEAKER

(71) Applicant: AAC Technologies Pte. Ltd., Singapore (SG)

(72) Inventor: Lubin Mao, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

This patent is subject to a terminal disclaimer.

(21) Appl. No.: 15/412,314

(22) Filed: Jan. 23, 2017

(65) Prior Publication Data

US 2018/0027334 A1 Jan. 25, 2018

(30) Foreign Application Priority Data

Jul. 21, 2016 (CN) ..... 2016 2 0776467 U

(51) Int. Cl.

| | |
|---|---|
| ***H04R 1/00*** | (2006.01) |
| ***H04R 9/06*** | (2006.01) |
| ***H04R 7/18*** | (2006.01) |
| ***H04R 9/02*** | (2006.01) |
| ***H04R 7/12*** | (2006.01) |

(52) U.S. Cl.

CPC ..... *H04R 9/06* (2013.01); *H04R 7/127* (2013.01); *H04R 7/18* (2013.01); *H04R 9/025* (2013.01)

(58) Field of Classification Search

CPC . H04R 1/127; H04R 7/18; H04R 9/06; H04R 9/025

See application file for complete search history.

(56) References Cited

U.S. PATENT DOCUMENTS

2004/0218778 A1* 11/2004 Weisman ..... H04R 7/16 381/396
2005/0276434 A1* 12/2005 Kobayashi ..... H04R 9/06 381/396
2006/0162993 A1* 7/2006 Honda ..... H04R 7/18 181/172
2014/0029782 A1* 1/2014 Rayner ..... H04R 1/2834 381/386
2014/0056464 A1* 2/2014 Li ..... H04R 9/025 381/400
2015/0319535 A1* 11/2015 Xu ..... H04R 7/18 381/412
2015/0365744 A1* 12/2015 Cai ..... H04R 1/023 381/412
2016/0173990 A1* 6/2016 Park ..... H04R 1/06 381/354
2016/0205476 A1* 7/2016 Huang ..... H04R 31/006 381/398
2017/0013381 A1* 1/2017 Zhang ..... H04R 29/003
2017/0332174 A1* 11/2017 Lee ..... H04R 9/027

* cited by examiner

*Primary Examiner* — Tuan D Nguyen
(74) *Attorney, Agent, or Firm* — Na Xu; IPro, PLLC

(57) ABSTRACT

A miniature speaker includes a frame and a vibrating system accommodated in the frame. The vibrating system includes a diaphragm fixed on the frame and a voice coil for driving the voice diaphragm to vibrate. The speaker further includes a magnetic circuit system. The diaphragm includes a first suspension positioned at a middle portion thereof, a second suspension positioned at an edge thereof, and a dome connecting the first suspension with the second suspension; and the magnetic circuit system is connected with the first suspension and is suspended in the frame by the first suspension.

8 Claims, 4 Drawing Sheets

MINIATURE SPEAKER

FIELD OF THE INVENTION

The invention is related to electro-acoustic transducers, more particularly to a miniature speaker used in a portable consumer device.

DESCRIPTION OF RELATED ART

With the coming of mobile internet times, the quantity of intelligent mobile device is rising continuously. Among many mobile equipment, mobile phone is the most common and portable mobile terminal equipment. At present, the function of mobile phone is diversified. One of important functions is that of high quality music, and the miniature speaker in mobile phone is one of the essential conditions of realizing the function of high quality music.

In relevant technology, the miniature speaker shall produce sound by vibrating the diaphragm by using the voice coil. The following problems may occur when the above-mentioned sounding method is taken: 1. The sensitivities of medium-high frequencies of the miniature speaker are high, while the sensitivity of low frequency is relatively low as a result of high resonant frequency of the miniature speaker when the volume of the cavity is kept still; the vibrating mass shall be increased in order to reduce the resonant frequency and improve the sensitivity of low frequency of the miniature speaker, but the sensitivity of high frequency of the miniature speaker would be reduced.

Therefore, it is necessary to provide an improved miniature speaker to overcome above disadvantage.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENTS

The present invention will hereinafter be described in detail with reference to several exemplary embodiments. To make the technical problems to be solved, technical solutions and beneficial effects of the present disclosure more apparent, the present disclosure is described in further detail together with the figures and the embodiments. It should be understood the specific embodiments described hereby are only to explain this disclosure, not intended to limit this disclosure.

Embodiment 1

Figure 1:
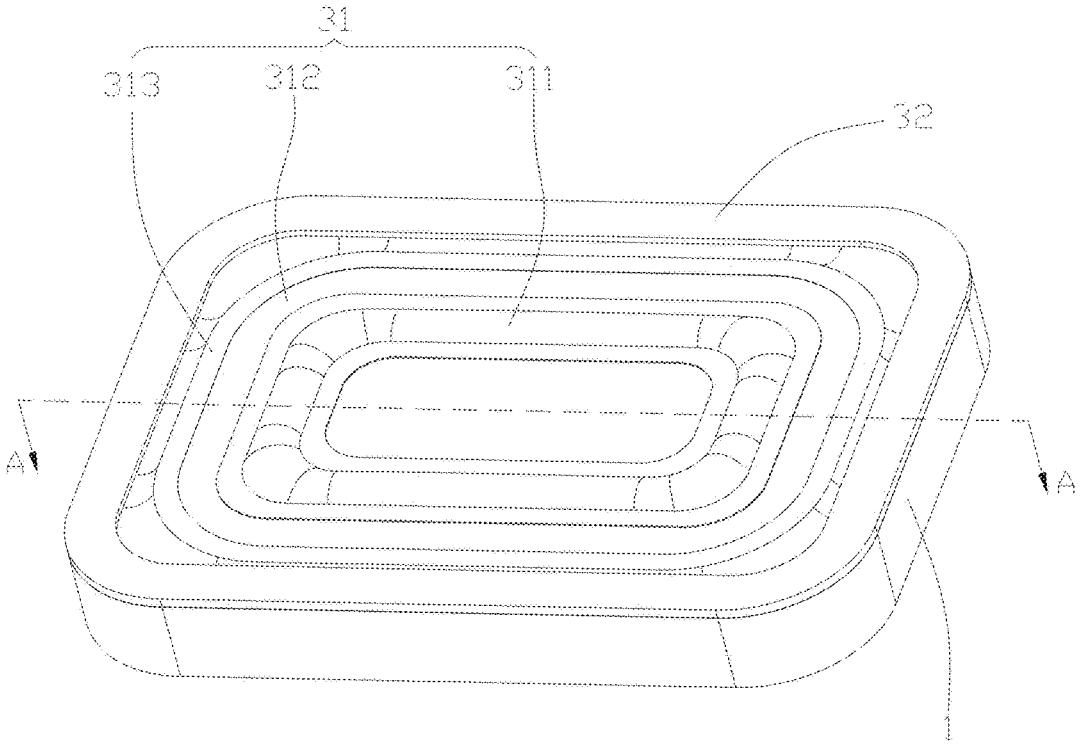
FIG. 1 is an isometric view of a miniature speaker in accordance with a first exemplary embodiment of the present disclosure.
Figure 2:
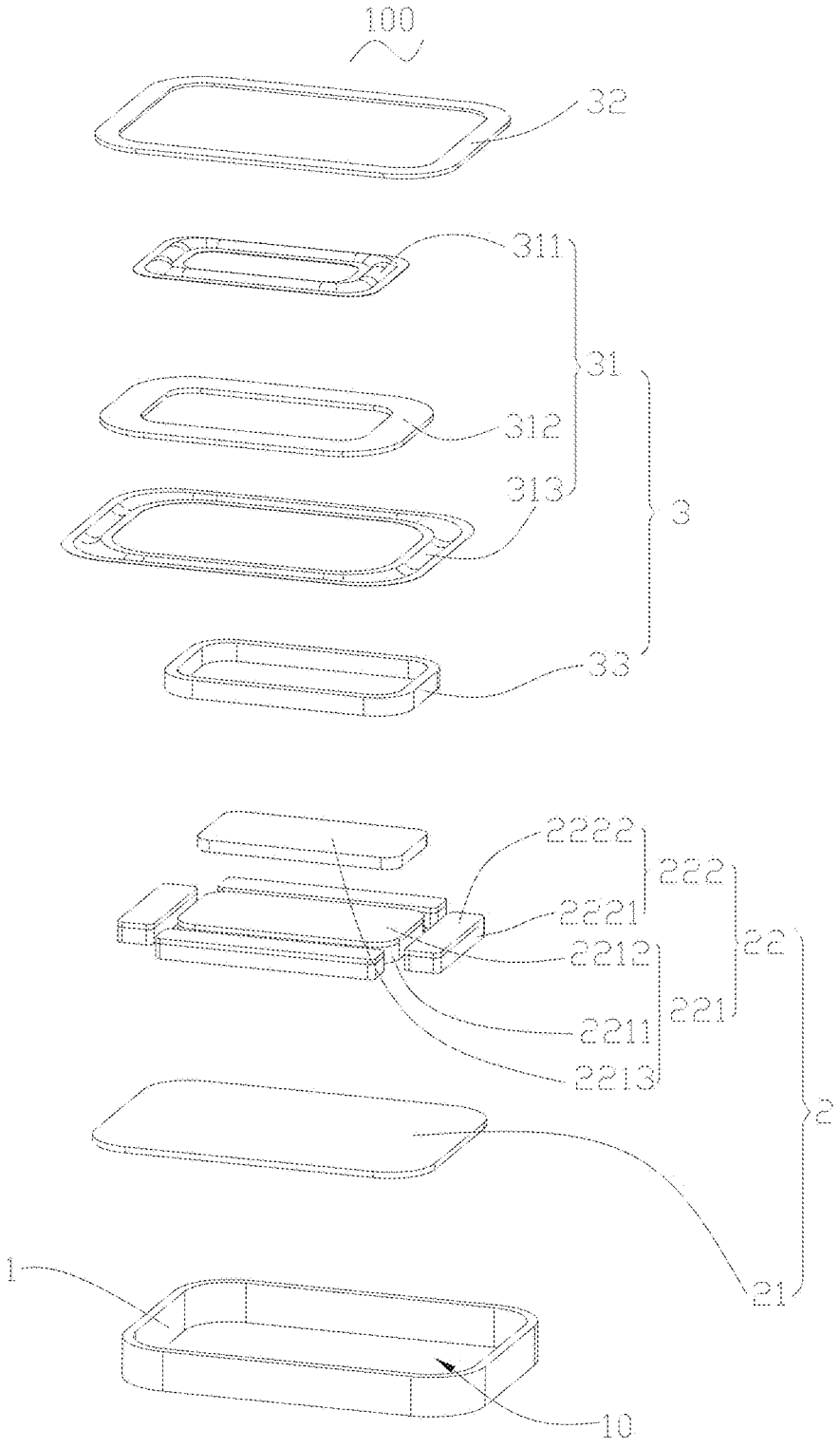
FIG. 2 is an exploded view of the miniature speaker in FIG. 1.
Figure 3:
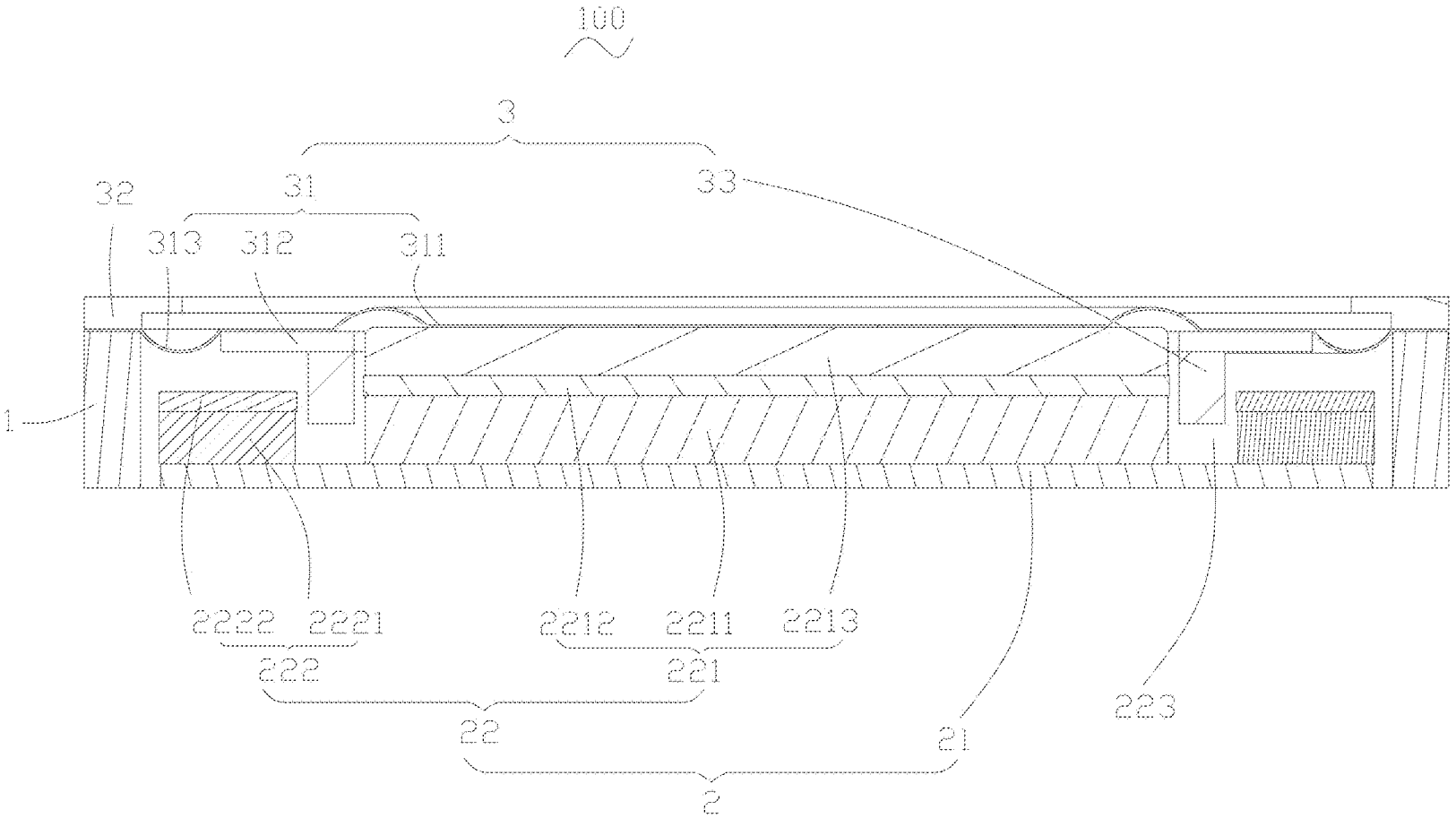
FIG. 3 is a cross-sectional view of the miniature speaker taken along line A-A in FIG. 1.

Referring to FIGS. 1-3, a miniature speaker 100 in accordance with a first embodiment of the present disclosure comprises a frame 1 having an accommodating space 10, a magnetic circuit system 2, and a vibrating system 3 accommodated in the accommodating space 10. The vibrating system 3 is driven by the magnetic circuit system 2 to produce sound by vibration.

The magnetic circuit system 2 comprises a yoke 21 which is arranged in the accommodating space 10 and a magnetic part 22 arranged in the yoke 21. The yoke 21 is a flat plate.

The magnetic part 22 comprises a first magnetic part 221 and a second magnetic part 222; the second magnetic part 222 is arranged around the first magnetic part 221 and forms a magnetic gap 223 with the first magnetic part 221.

The first magnetic part 221 comprises a first main magnet 2211 which is arranged on the yoke 21, a main pole plate 2212 which is overlapped on the first main magnet 2211 and a second main magnet 2213 which is overlapped on the main pole plate 2212; and the same magnetic poles of the first main magnet 2211 and the second main magnets 2213 are arranged face to face.

The quantity of the second magnetic parts 222 is four, and comprises an auxiliary magnet 2221 arranged on the yoke 21 and an auxiliary pole plate 2222 overlapped on the auxiliary magnet 2221. Moreover, the vibrating system 3 comprises a voice diaphragm 31 and a voice coil 33 which drives the voice diaphragm 31 to vibrate.

The miniature speaker 100 further comprises a gasket 32 which is overlapped on one side of the voice diaphragm 31 far from the frame 1.

The voice diaphragm 31 comprises a first suspension 311, a dome 312 and a second suspension 313, wherein the first suspension 311 is positioned at the middle place of the voice diaphragm 31. The second suspension 313 is positioned on an edge of the voice diaphragm 31, and the dome 312 connects the first suspension 311 with the second suspension 313; the first magnetic part 221 is fixed on internal periphery of the first suspension 311; the first suspension 311 is connected with the first magnetic part 221 fixedly, therefore the magnetic circuit system 2 is suspended in the frame 1; one end of the second suspension 313 far from the dome 312 is connected with the frame 1, specifically the second suspension 313 is connected with the frame 1 on one side opposite to the yoke 21.

The gaskets 32 are arranged one side of the frame 1 opposite to the yoke 21 and are presented as the hollow rings. One end of the voice coil 33 is connected with the dome 312, and the other end thereof is inserted into the magnetic gap 223.

The voice diaphragm 31 is driven by the voice coil 33 to vibrate in order to give out sound in presence of magnetic field force of the magnetic circuit system 2 when the voice coil 33 is electrified; therefore the high sensitivities of medium-high frequencies can be implemented; at the same time, the magnetic circuit system 2 is driven by the first suspension 311 of the voice diaphragm 31 to vibrate, therefore the high sensitivity of low frequency can be implemented.

Embodiment 2

Figure 4:
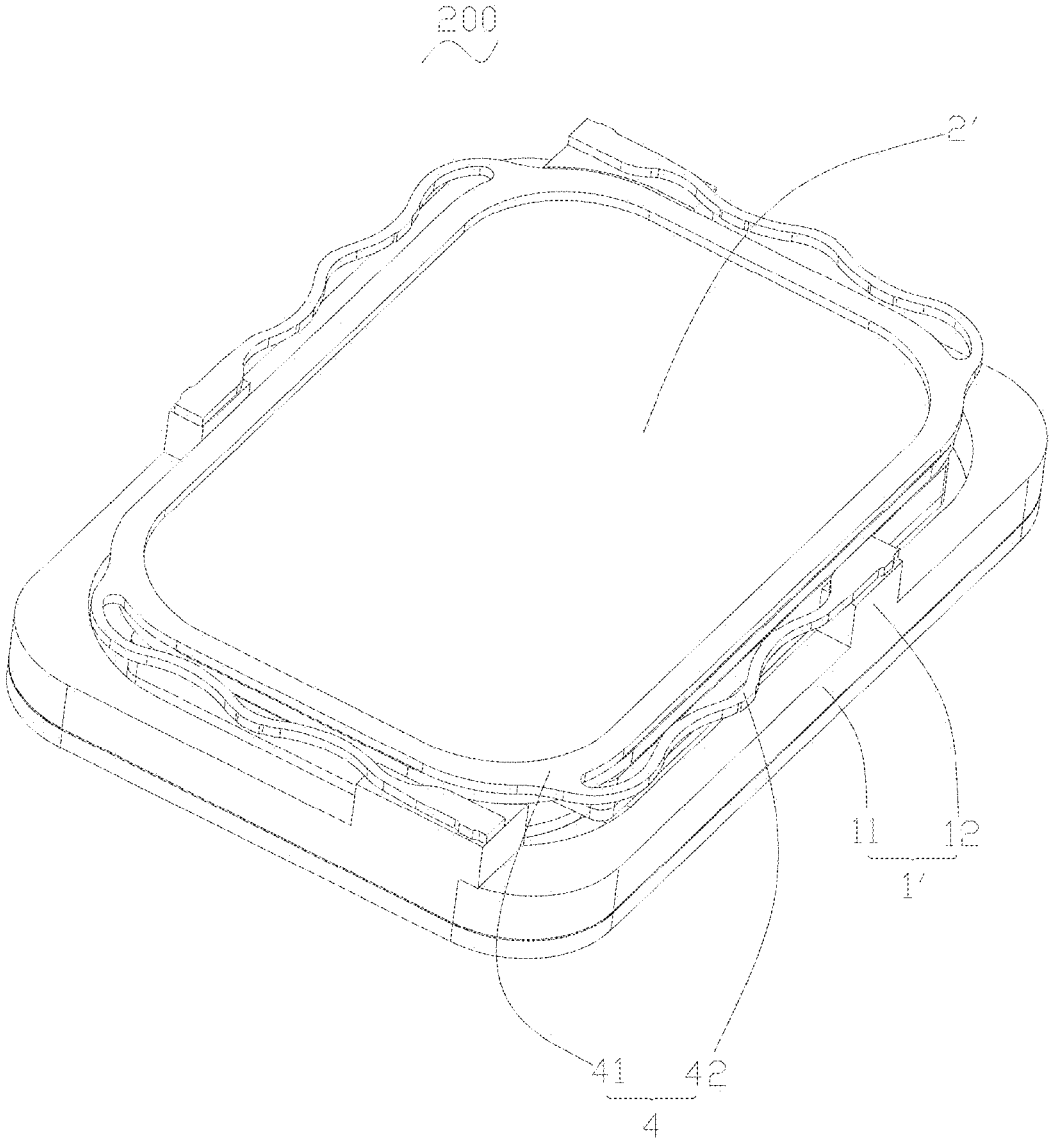
FIG. 4 is an isometric view of a miniature speaker in accordance with a second exemplary embodiment.

Referring to FIG. 4, the main differences of Embodiment 2 from Embodiment 1 are as follows:

The miniature speaker 200 in the present disclosure further comprises a spring 4 for supporting the magnetic circuit system 2 elastically, wherein the spring 4 comprises a main body 41 connecting with the magnetic circuit system 2' and an extended part 42 formed in the way of extending from the outer edge of the main body 41; the extended part

42 is connected with the frame 1 fixedly; the main body 41 is presented as a ring in shape, while the extended part 42 is presented as a bent part. Moreover, multiple extended parts 42 are arranged; and the number thereof 42 is 4 in this embodiment.

The frame 1' comprises a frame main body 11 and a projecting part 12 formed in the way of extending from the frame main body 11. The extended part 42 is connected with the projecting part 12 fixedly. Moreover, multiple projecting parts 12 are arranged; and the number thereof is 4 in this embodiment.

Compared with related technology, the advantages of the present disclosure are that:

1. The vibration system comprises the voice diaphragm and the voice coil. The voice diaphragm is set to comprise the first suspension and the second suspension. The voice coil do vibration of normal middle and high frequency to achieve comparatively high sensitivity for normal middle and high frequency. The circuit system is connected with the first suspension and is suspended in the frame by the first suspension, it can do vibration of low frequency to achieve comparatively high sensitivity for low frequency, so it is ensured to realize improving the sensitivity of low frequency under the condition that sensitivity for the high frequency doesn't change, 2. The circuit system is supported by the spring, so the problem that the first suspension possibly can not support the magnet system can be prevented, which is good for the sealing of the first suspension and vibration and sounding of the same.

It is to be understood, however, that even though numerous characteristics and advantages of the present exemplary embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A miniature speaker, including:

a frame;

a vibrating system accommodated in the frame, the vibrating system including a diaphragm fixed on the frame and a voice coil for driving the voice diaphragm to vibrate;

a magnetic circuit system; wherein the diaphragm includes a first suspension positioned at a middle portion thereof, a second suspension positioned at an edge thereof, and a dome connecting the first suspension with the second suspension; and the magnetic circuit system is connected with the first suspension and is suspended in the frame by the first suspension.

2. The miniature speaker as described in claim 1 further comprising a spring fixed in the frame and supporting the magnetic circuit system elastically.

3. The miniature speaker as described in claim 2, wherein the spring comprises a main body supporting the magnetic circuit system, and an extended part extending from an outer edge of the main body and connected with the frame.

4. The miniature speaker as described in claim 3, wherein the frame comprises a frame main body, and a projecting part extending from the frame main body away from the vibrating system; the extended part is connected with the projecting part.

5. The miniature speaker as described in claim 1, wherein the magnetic circuit system comprises a yoke and a magnetic part arranged on the yoke; the magnetic part comprises a first magnetic part connecting with the first suspension and a second magnetic part arranged around the first magnetic part for forming a magnetic gap; at least one of the first magnetic part and the second magnetic part includes a permanent magnet.

6. The miniature speaker as described in claim 5, wherein the first magnetic part comprises a first main magnet arranged on the yoke, a main pole plate and a second main magnet overlapped on the first main magnet; the same magnetic poles of the first main magnet and the second main magnet are arranged face to face; one side of the second main magnet far from the main pole plate is connected with the first suspension.

7. The miniature speaker as described in claim 5, wherein the second magnetic part comprises an auxiliary magnet arranged on the yoke and an auxiliary pole plate attached to the auxiliary magnet.

8. The miniature speaker as described in claim 1 further comprising a gasket attached to one side of the voice diaphragm far from the frame.

* * * * *